US008295532B2

(12) United States Patent
Hsu et al.

(10) Patent No.: US 8,295,532 B2
(45) Date of Patent: Oct. 23, 2012

(54) METHOD AND SYSTEM FOR WIRELESS HEADSET INSTANT ON CAPABILITY DURING BATTERY CHARGING

(75) Inventors: David Hsu, Cupertino, CA (US); John Walley, Ladera Ranch, CA (US)

(73) Assignee: Broadcom Corporation, Irvine, CA (US)

( * ) Notice: Subject to any disclaimer, the term of this patent is extended or adjusted under 35 U.S.C. 154(b) by 1304 days.

(21) Appl. No.: 12/013,261

(22) Filed: Jan. 11, 2008

(65) Prior Publication Data

US 2009/0180638 A1 Jul. 16, 2009

(51) Int. Cl.
*H04R 25/00* (2006.01)

(52) U.S. Cl. ..... 381/384; 381/370

(58) Field of Classification Search ..... 381/77, 381/79, 80, 81, 85, 309
See application file for complete search history.

(56) References Cited

U.S. PATENT DOCUMENTS

| | | | | |
|---|---|---|---|---|
| 4,284,944 | A * | 8/1981 | Iwanaga et al. | 320/139 |
| 2002/0117998 | A1 * | 8/2002 | Olsen | 320/135 |
| 2006/0025074 | A1 * | 2/2006 | Liang et al. | 455/41.2 |
| 2007/0093279 | A1 * | 4/2007 | Janik | 455/569.1 |

* cited by examiner

*Primary Examiner* — Ha Tran T Nguyen
*Assistant Examiner* — Kevin Quinto
(74) *Attorney, Agent, or Firm* — Thomas, Kayden, Horstemeyer & Risley, LLP

(57) ABSTRACT

Methods and systems for wireless headset instant on capability during battery charging are disclosed and may include powering a wireless headset so that it may be operable to transmit/receive wireless signals during charging. The headset may be powered via an external charger and may be coupled to the headset via a USB link. The headset may be powered via one or more internal batteries, and may be independent of a power level of the batteries within the headset. RF and baseband circuitry may be powered for transmitting/receiving wireless signals during charging. The headset may utilize USB power management, and may manage discharge of power from a plurality of internal batteries. The batteries may be decoupled from circuits that enable transmitting/receiving wireless signals during charging. The headset may be powered via the charging device so that the headset may be operable to generate output audio signals during charging.

36 Claims, 5 Drawing Sheets

METHOD AND SYSTEM FOR WIRELESS HEADSET INSTANT ON CAPABILITY DURING BATTERY CHARGING

CROSS-REFERENCE TO RELATED APPLICATIONS/INCORPORATION BY REFERENCE

[Not Applicable]

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to audio headphones. More specifically, certain embodiments of the invention relate to a method and system for headset instant on capability during battery charging.

BACKGROUND OF THE INVENTION

Headphones were originally utilized for personal enjoyment of music without distracting other people in the vicinity of the music source. Headphones may comprise circumaural, earphones, and canal phones. Circumaural headphones cover the ears and are rather large, more attuned for home audio applications as compared to use with portable audio devices. Earphones are typically used in portable audio device applications, with cassette tape, compact disc and MP3 players, for example. The application of earphones later extended into cellular phone applications, typically as a single earpiece, as the danger of operating motor vehicles while utilizing a cellular phone was established.

With the development of wireless technology, wireless headphones have become more and more prevalent. Bluetooth headsets and/or earpieces have expanded significantly in usage as more cellular phone users have discovered the ease of use with hands-free operation, not only in automotive applications, but in any application where hands-free operation is preferred.

Further limitations and disadvantages of conventional and traditional approaches will become apparent to one of skill in the art, through comparison of such systems with the present invention as set forth in the remainder of the present application with reference to the drawings.

BRIEF SUMMARY OF THE INVENTION

A system and/or method for wireless headset instant on capability during battery charging, substantially as shown in and/or described in connection with at least one of the figures, as set forth more completely in the claims.

Various advantages, aspects and novel features of the present invention, as well as details of an illustrated embodiment thereof, will be more fully understood from the following description and drawings.

DETAILED DESCRIPTION OF THE INVENTION

Certain aspects of the invention may be found in a method and system for wireless headset instant on capability during battery charging. Exemplary aspects of the invention may comprise powering a wireless headset so that the wireless headset may be operable to transmit and/or receive wireless signals while being charged. The headset may be powered via an external charging power source coupled to the headset to enable the charging. The external charging power source may be coupled to the headset via a USB link. The headset may be powered via one or more internal batteries within the headset, and may be independent of a power level of the batteries within the headset. RF and baseband circuitry within the wireless headset may be powered so as to enable transmission and/or reception of wireless signals while the headset may be charged. The wireless headset may manage power utilizing USB power management, and may manage discharge of power from a plurality of internal batteries within the headset. The batteries may be electrically decoupled from circuits that enable transmitting and/or receiving of wireless signals when the headset is being charged. The wireless headset may be powered via the charging device so that the headset may be operable to generate output audio signals during the charging of the headset.

Figure 1:
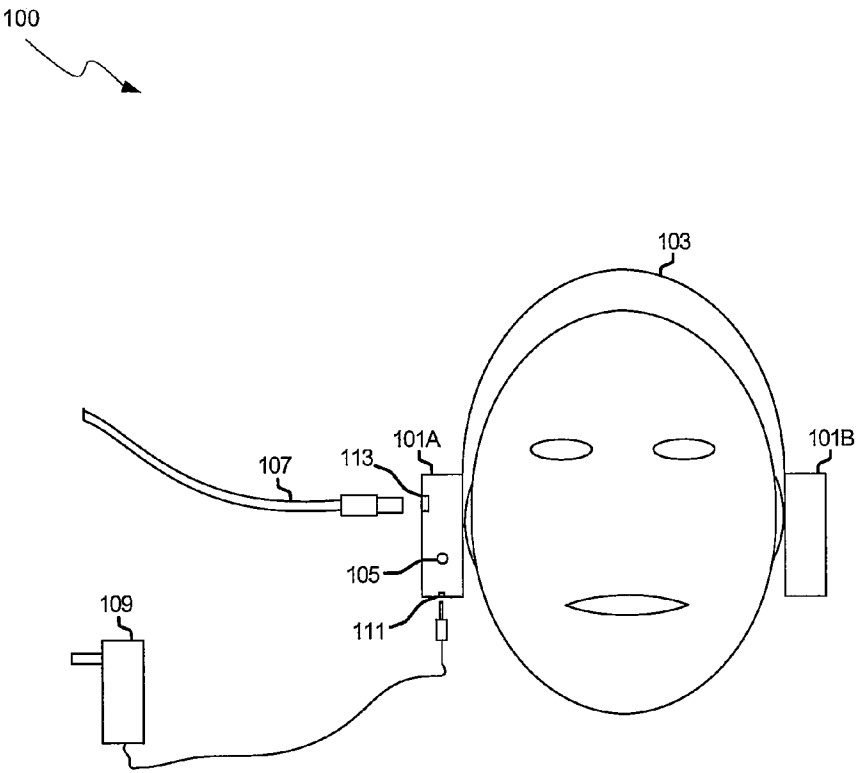
FIG. 1 is a block diagram of an exemplary wireless headset, in accordance with an embodiment of the invention.

FIG. 1 is a block diagram of an exemplary wireless headset, in accordance with an embodiment of the invention. Referring to FIG. 1, there is shown wireless headset 100 comprising ear pieces 101A and 101B and a support piece 103. The support piece 103 may provide support and electrical connection for the two ear pieces 101A and 101B. The ear piece 101A may comprise a light emitting diode (LED) 105, a charging port 111 and a USB port 113. The ear pieces 101A and 101B may also comprise one or more circuits and one or more batteries for controlling and powering the wireless headset 100, respectively, which may be located internal to the wireless headset 100. There is also shown a charger 109 and a USB cable 107.

The charger 109 may comprise suitable circuitry, logic and/or code that may be enabled to charge the batteries in the wireless headset 100. The USB cable 107 may comprise a standard USB cable that may be utilized to couple the wireless headset 100 to an external device, such as a computer, for example. The USB cable 107 may be utilized to configure the wireless headset 100, for example, and may also be utilized to charge the batteries in the wireless headset 100.

The LED 105 may comprise a visible LED that may be utilized to indicate a status of the wireless headset 100 during a charging process, for example, utilizing the charger 109 via the charging port 111 or utilizing the USB cable 107 via the USB port 113. The number of LEDs utilized on the wireless headset 100 may not be limited to the one LED 105 shown in FIG. 1. Accordingly, any number of LEDs may be utilized depending on the number of functions and/or states to be indicated.

The wireless headset 100 may comprise an instant on function, where one or more circuits enable operation of the wireless headset 100 in instances when a power source may be coupled to the wireless headset 100, independent of the status of the batteries, i.e. even when the batteries may be below a minimum threshold voltage level needed to power the circuits within the wireless headset 100. Conventional headsets are inoperative when the one or more batteries are below a threshold voltage level, even when coupled to a charging source.

In operation, the wireless headset 100 may be powered by a battery internal to the wireless headset 100. The wireless headset 100 may be enabled to playback audio signals received wirelessly from sources such as an FM or Bluetooth transmitter, for example. In instances when the battery voltage may drop below a threshold value required to power the wireless headset 100, an external power source, such as the charger 109 and/or the USB cable 107 may be coupled to the wireless headset 100. The wireless headset 100 may comprise an instant on function, which may activate circuitry needed for functions related to the charging process and also desired communication functions. For example, baseband circuitry that may enable communication with external devices, via Bluetooth and/or USB, for example, may be powered by the external power source. In this manner, the wireless headset 100 may be configured to a desired state even in instances where one or more batteries in the wireless headset 100 may be completely drained and/or below a minimum threshold voltage required to power circuitry within the wireless headset 100.

In an exemplary embodiment of the invention, the LED 105 may indicate whether the charging process enabled by the charger 109 and/or the USB cable 107 may be functioning properly. The one or more batteries may be switched off from the circuitry in the wireless headset 100, and the voltage from the charging source may be used to directly power the wireless headset 100. The circuitry that may be enabled during the charging process may comprise power handling circuitry, such that the wireless headset 100 may be enabled to determine the approximate charging time and/or charging current that may be needed to completely charge the one or more batteries. In this manner, charging algorithms may be adjusted by the power handling circuitry to optimize the battery lifetime and the charging time.

In an embodiment of the invention, the one or more batteries in the headset 100 may be charged in an alternating fashion to optimize battery lifetime. In an another embodiment of the invention, the ear pieces 101A and 101B may be separated for monaural operation, and the charging of the one or more batteries may proceed accordingly, such that the one or more batteries in the appropriate earpiece 101A or 101B may be charged first.

Figure 2:
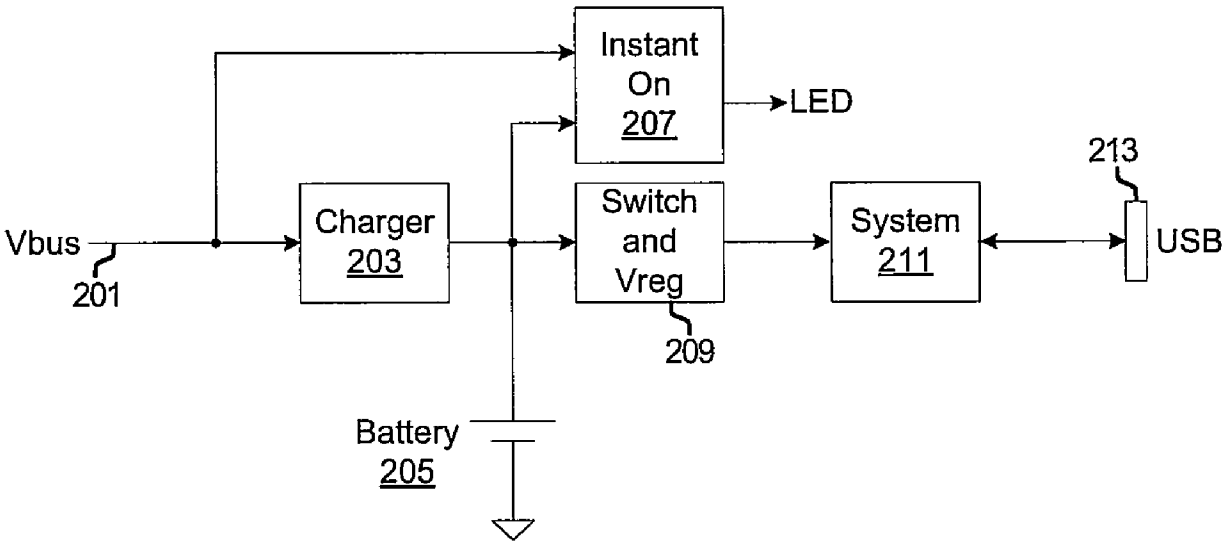
FIG. 2 is a block diagram of exemplary circuitry enabling an instant on LED indication feature in a wireless headset, in accordance with an embodiment of the invention.

FIG. 2 is a block diagram of exemplary circuitry enabling an instant on LED indication feature in a wireless headset, in accordance with an embodiment of the invention. Referring to FIG. 2, there is shown a charger block 203, a battery 205, an instant on block 207, a switch and voltage regulator (Vreg) block 209, a system block 211 and a USB port 213. There is also shown a power supply voltage, Vbus 201. The battery 205 may comprise one or more batteries that may be utilized to power the wireless headset 100, described with respect to FIG. 1.

The charger block 203 may comprise suitable circuitry, logic and/or code that may enable charging of the battery 205, and may supply an appropriate voltage and current for charging the battery 205. The charger block 203 may be enabled to receive as an input voltage, the voltage Vbus 201, and to generate an output that may be coupled to the positive terminal of the battery 205, an input of the instant on block 207 and an input to the switch and Vreg block 209.

The instant on block 207 may comprise suitable circuitry, logic and/or code that may be enabled to provide charger and battery status in instances when a charging source may be coupled to the wireless headset 100 generating the voltage Vbus 201. The instant on block 207 may also be coupled to the positive terminal of the battery 205. The output terminal of the instant on block 207 may be utilized to activate an LED, such as the LED 105, described with respect to FIG. 1, to indicate the status of the battery 205 and/or the charging process.

The switch and Vreg block 209 may comprise suitable circuitry, logic and/or code that may enabled to control power supplied to the system block 211. The switch and Vreg block 209 may comprise switching and regulating circuitry to enable or disable the voltage and also regulating the voltage to a preferred value, which may be communicated to the system block 211. In an embodiment of the invention, the regulating circuitry may comprise low dropout regulators.

The system block 211 may comprise the remaining circuitry controlling the operation of the wireless headset 100. The circuitry may comprise the baseband digital circuitry, control and status registers, and RF and audio signal processing and amplification circuits, for example.

In operation, the battery 205 may supply the voltage to drive the circuitry comprising the switch and Vreg block 209 and the system block 211. The circuitry may control the operation of the wireless headset 100, and may receive RF signals comprising audio signals to be played back by the wireless headset 100. In instances when the voltage of the battery 205 may fall below a threshold level required to enable the operation of the system block 211, an external power supply may be coupled to the charger 203 to supply the voltage Vbus 201.

The voltage Vbus 201 may be communicated to the charger block 203, which may supply a voltage to charge the battery 205. The voltage Vbus 201 may also be communicated to the instant on block 207. The instant on block 207 may sense the voltage from the battery 205 and may determine charging process characteristics, such as charging time and whether the battery may be accepting the charge, for example. A status of the charging process may be indicated by a LED, such as the LED 105, described with respect to FIG. 1. The LED may provide an indication that the charging process is proceeding.

In an embodiment of the invention, the instant on block 207 may sense other characteristics of the wireless headset 100 that may impact the charging process. In an exemplary embodiment of the invention, the temperature of the circuitry or the ambient temperature within the wireless headset 100 may be sensed and enable a blinking pattern in the LED to indicate an acceptable or unacceptable temperature. The instant on block 207 may enable instant user feedback that the charging process is proceeding properly even when the charge in the battery 205 may be too low for the headset 100 to operate.

Figure 3:
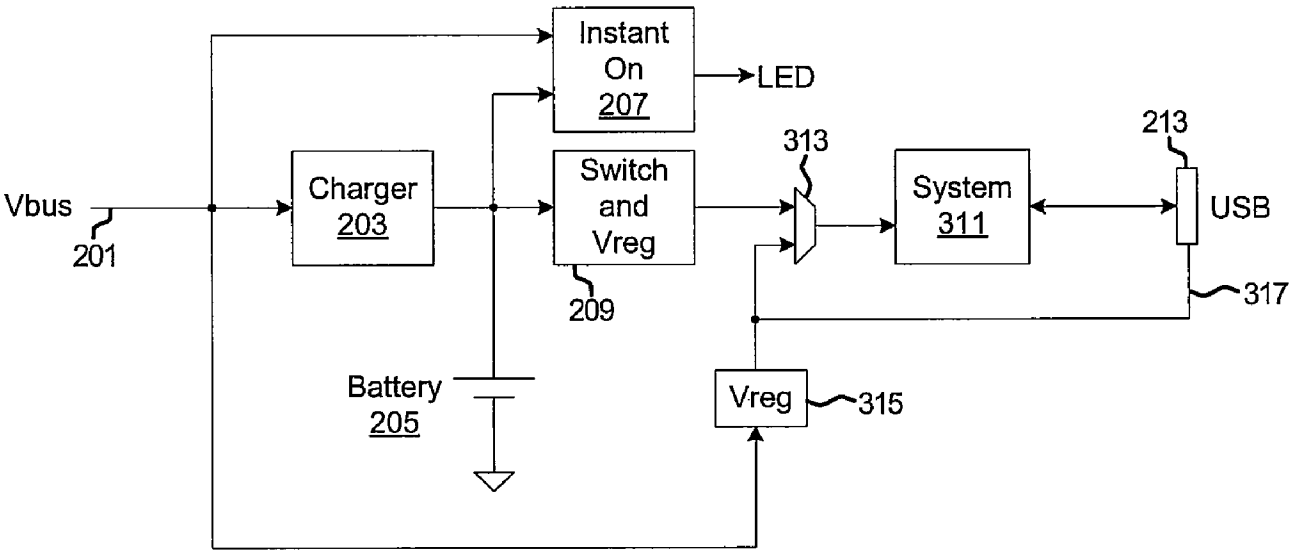
FIG. 3 is a block diagram of exemplary circuitry that enables an instant on circuit feature in a wireless headset, in accordance with an embodiment of the invention.

FIG. 3 is a block diagram of exemplary circuitry that enables an instant on circuit feature in a wireless headset, in accordance with an embodiment of the invention. Referring to FIG. 3, there is shown the charger block 203, the battery 205, the instant on block 207, the switch and Vreg block 209, a system block 311, a multiplexer (MUX) 313 and a voltage regulator (Vreg) block 315. There is also shown a USB voltage 317. The charger block 203, the battery 205, the instant on block 207 and the switch and Vreg block 209 may be as described with respect to FIG. 2.

The MUX 313 may comprise suitable circuitry, logic and/or code that may be enabled to select one of a plurality of inputs to be communicated to the output of the MUX 313. The output of the switch and Vreg block 209, the Vreg block 315 and the USB port 213 may be coupled to the inputs of the MUX 313. The output of the MUX 313 may be communicatively coupled to the input of the system block 311.

The Vreg block 315 may comprise suitable circuitry, logic and/or code that may enabled to regulate an input voltage to generate an output voltage at a desired level. In an embodiment of the invention, the Vreg block 315 may comprise one or more low dropout regulators. The Vreg 315 may receive as an input the voltage Vbus 201, which may comprise the voltage supplied by an external charging source such as the charger 109 described with respect to FIG. 1.

The USB port 213 may comprise a port to which a USB cable, such as the USB cable 107, may be coupled, and may also supply a voltage, the USB voltage 317, that may be communicatively coupled to an input of the MUX 313. In this manner, a voltage may be communicatively coupled to the MUX 313 via the USB port 213 or the voltage Vbus 201 via the Vreg block 315.

In operation, the battery 205 may supply a voltage to drive the circuitry comprising the switch and Vreg block 209 and the system block 311. The circuitry may control the operation of the wireless headset 100, and may enable reception of RF signals comprising audio signals to be played back by the wireless headset 100. In instances when the voltage of the battery 205 may fall below a threshold level required to enable the operation of the system block 311, an external power supply may be coupled to the charger 203 to supply the voltage Vbus 201, or a supply voltage, the USB voltage 317, may be communicatively coupled from the USB port 213 to the MUX 313.

The voltage Vbus 201 may be communicated to the charger block 203, which may supply a voltage to charge the battery 205. The voltage Vbus 201 may also be communicated to the instant on block 207. The instant on block 207 may sense the voltage from the battery 205 and may determine charging process characteristics, such as charging time and whether the battery may be accepting the charge, for example. A status of the charging process may be indicated by a LED, such as the LED 105, described with respect to FIG. 1. The LED may provide an indication that the charging process is proceeding.

The voltage Vbus 201 may also be communicated to the Vreg block 315, which may regulate the received voltage to a level appropriate for the system block 311. The output of the Vreg block 315 may be communicated to the MUX 313. The MUX 313 may be enabled to select the output voltage of the Vreg 315, and communicate this voltage to the system block 311. Activating the system block 311 with the voltage Vbus 201 via the Vreg block 315 and the MUX 313 may allow the wireless headset 100 to function even when the voltage of the battery 205 may be below a threshold level required by the system block 311. In this manner, the wireless headset 100 may be configured remotely, via Bluetooth communication, for example, while being charged. Additionally, data downloads may be performed from external devices either wirelessly or via USB, for example. Since the battery may not be under a load during charge and recharge, the battery capacity may be increased. Additionally, utilizing the charging source, the voltage Vbus 201 in this case, may allow heavy system loads, such as scanning for other devices to connect to, to be performed for example, even though the battery 205 may be low.

In another embodiment of the invention, a supply voltage may be communicated to the MUX 313 from the USB port 213. The MUX 313 may be enabled to select the voltage supplied to the USB port 213 via a USB cable, such as the USB cable 107, for example, and communicate this voltage to the system block 311. Activating the system block 311 with the USB voltage USB port 213 and the MUX 313 may allow the wireless headset 100 to function even when the voltage of the battery 205 may be below a threshold level required by the system block 311.

In an embodiment of the invention the one or more battery cells that may comprise the battery 205 may be charged in an alternating fashion to optimize battery lifetime. Once the battery 205 may be completely charged, the charging source may be decoupled, the MUX 313 may select the voltage from the battery 205 via the switch and Vreg block 209 as the voltage source to be communicated to the system block 311 and the wireless headset 100 may operate in its normal battery powered mode.

Figure 4:
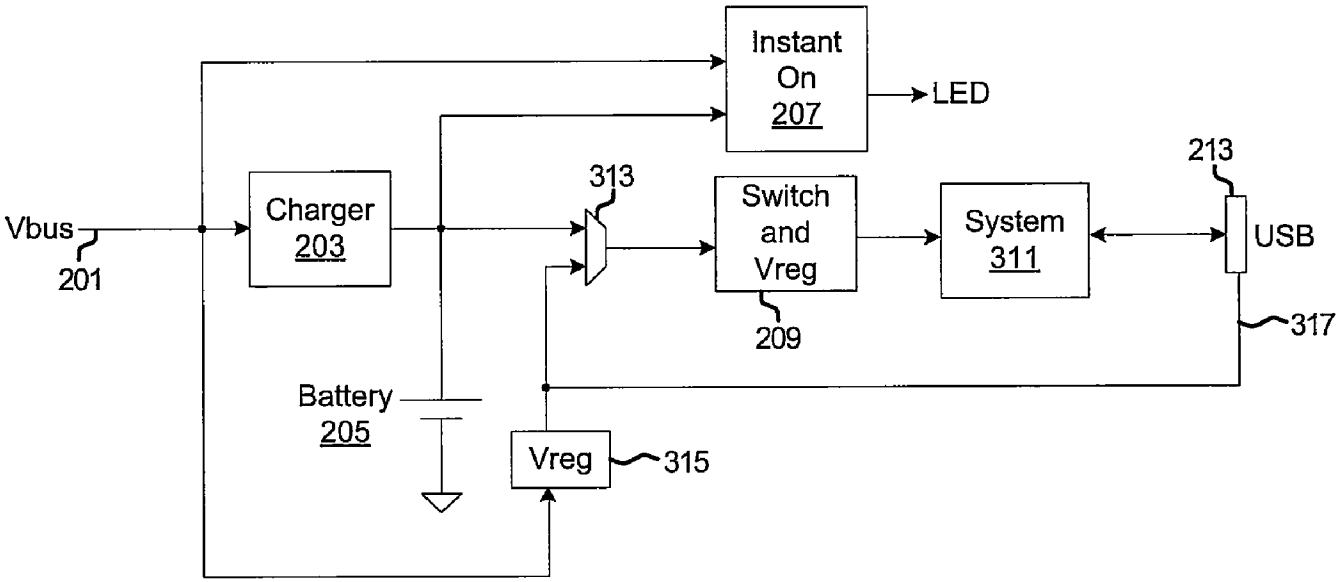
FIG. 4 is a block diagram illustrating exemplary circuitry enabling an instant on circuit enable feature with MUX prior to switching in a wireless headset, in accordance with an embodiment of the invention.

FIG. 4 is a block diagram illustrating exemplary circuitry enabling an instant on circuit enable feature with MUX prior to switching in a wireless headset, in accordance with an embodiment of the invention. Referring to FIG. 4, there is shown the charger block 203, the battery 205, the instant on block 207, the switch and Vreg block 209, a system block 311, a multiplexer (MUX) 313 and a voltage regulator (Vreg) block 315. The charger block 203, the battery 205, the instant on block 207 and the switch and Vreg block 209 may be as described with respect to FIG. 2.

The MUX 313 may comprise suitable circuitry, logic and/or code that may be enabled to select one of a plurality of inputs to be communicated to the output of the MUX 313. The output of the charger 203, the positive terminal of the battery 205 and an input of the instant on block 207 may be coupled to an input of the MUX 313. The output of the Vreg block 315 and the voltage bus of the USB port 213 may be coupled to the other input of the MUX 313. The output of the MUX 313 may be communicatively coupled to the input of the switch and Vreg block 209.

The Vreg block 315 may comprise suitable circuitry, logic and/or code that may enable regulating an input voltage to generate an output voltage at a desired level. In an embodiment of the invention, the Vreg block 315 may comprise one or more low dropout regulators. The Vreg 315 may receive as an input the voltage Vbus 201, which may comprise the voltage supplied by an external charging source such as the charger 109 described with respect to FIG. 1.

The USB port 213 may comprise a port to which a USB cable, such as the USB cable 107, may be coupled, and may also supply a voltage, the USB voltage 317, that may be communicatively coupled to an input of the MUX 313. In this manner, a voltage may be communicatively coupled to the MUX 313 via the USB port 213 or the voltage Vbus 201 via the Vreg block 315.

In operation, the battery 205 may supply a voltage to drive the circuitry comprising the system block 311. The circuitry may control the operation of the wireless headset 100, and may enable reception of RF signals comprising audio signals to be played back by the wireless headset 100. In instances when the voltage of the battery 205 may fall below a threshold level required to enable the operation of the system block 311, an external power supply may be coupled to the charger 203 to supply the voltage Vbus 201, or a supply voltage, the USB voltage 317, may be communicatively coupled from the USB port 213 to the MUX 313.

The voltage Vbus 201 may be communicated to the charger block 203, which may supply a voltage to charge the battery 205. The voltage Vbus 201 may also be communicated to the instant on block 207. The instant on block 207 may sense the voltage from the battery 205 and may determine charging process characteristics, such as charging time and whether the battery may be accepting the charge, for example. A status of the charging process may be indicated by an LED, such as the LED 105, described with respect to FIG. 1. The LED may provide an indication that the charging process is proceeding.

The voltage Vbus 201 may also be communicated to the Vreg block 315, which may regulate the received voltage to a level appropriate for the system block 311. The output of the Vreg block 315 may be communicated to the MUX 313. The MUX 313 may be enabled to select the output voltage of the Vreg 315, and communicate this voltage to the switch and Vreg block 209. The switch and Vreg block 209 may switch circuitry, such as the system block 311, on or off, and may regulate the output voltage received from the MUX 313 to an appropriate level for the system block 311. Activating the system block 311 with the voltage Vbus 201 via the Vreg block 315, the MUX 313 and the switch and Vreg block 209 may allow the wireless headset 100 to function even when the voltage of the battery 205 may be below a threshold level required by the system block 311. In this manner, the wireless headset 100 may be configured remotely, via Bluetooth communication, for example, while being charged. Additionally, data downloads may be performed from external devices either wirelessly or via USB, for example.

In another embodiment of the invention, a supply voltage, the USB voltage 317, may be communicated to the MUX 313 from the USB port 213. The MUX 313 may be enabled to select the voltage supplied to the USB port 213 via a USB cable, such as the USB cable 107, for example, and communicate this voltage to the system block 311 via the switch and Vreg block 209. Activating the system block 311 with the USB voltage 317 via the USB port 213, the MUX 313 and the switch and Vreg block 209 may allow the wireless headset 100 to function even when the voltage of the battery 205 may be below a threshold level required by the system block 311.

Once the battery 205 may be completely charged, the charging source may be decoupled, the MUX 313 may select the voltage from the battery 205 as the voltage source to be communicated to the system block 311 via the switch and Vreg block 209 and the wireless headset 100 may operate in its normal battery powered mode.

Figure 5:
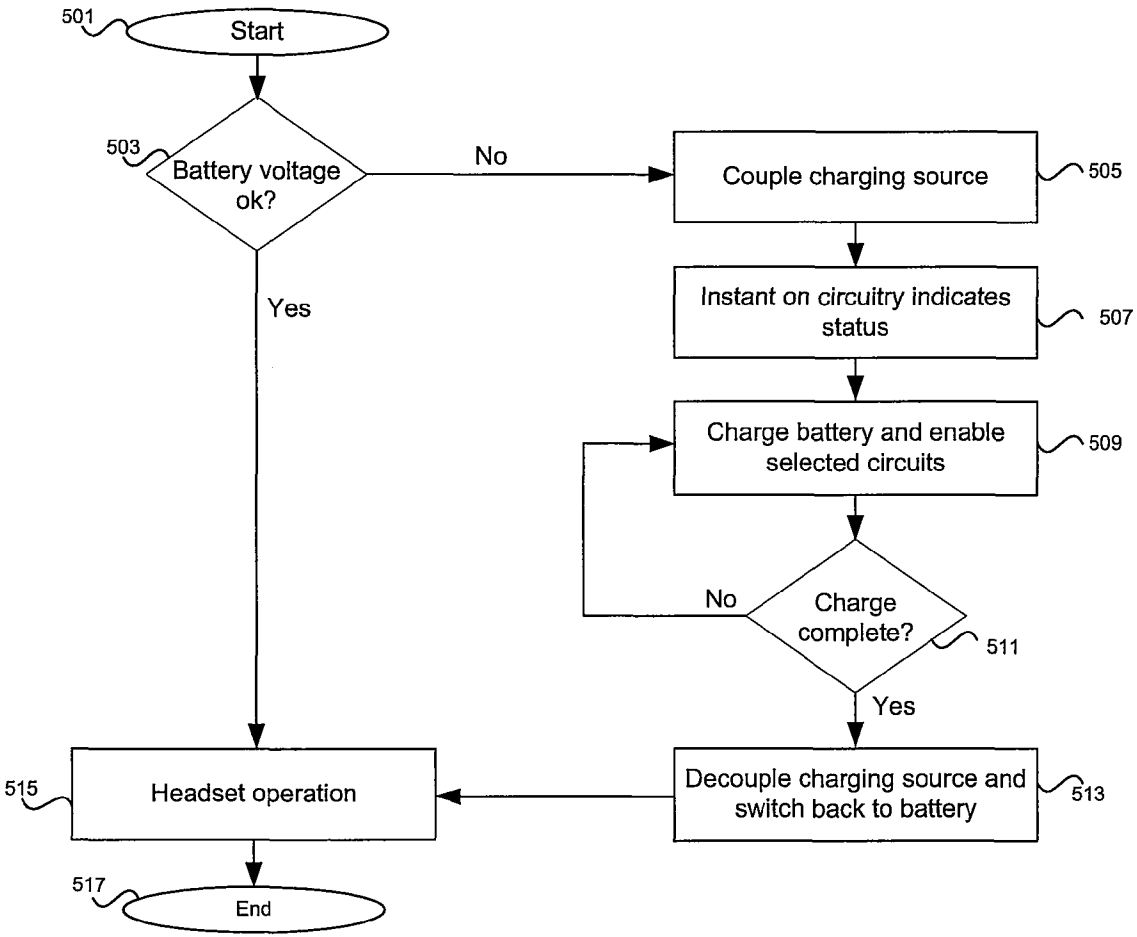
FIG. 5 is a flow diagram illustrating an exemplary operation of a wireless headset, in accordance with an embodiment of the invention.

FIG. 5 is a flow diagram illustrating an exemplary operation of a wireless headset, in accordance with an embodiment of the invention. Referring to FIG. 5, in step 503, following start step 501, the battery voltage may be measured to determine whether it may be high enough for proper operation of the wireless headset 100. If the voltage is not acceptable, the process may proceed to step 505 where a charging source may be coupled to the wireless headset 100, and in step 507, the instant on circuitry 207 may enable determination of the charging process characteristics and may indicate a charging status utilizing an LED 105. In step 509, the battery 205 may be charged and selected circuits may be enabled by the voltage supplied by the charging source. The enabled circuits may provide power management function, wireless communication for wireless headset 100 configuration, or file download, for example. In step 511, if the charging process may not be complete, the process may loop back to step 509 to continue charging. If the charging may be complete, the process may proceed to step 513 where the charging source may be decoupled and the MUX 313 may enable switching back to battery power. The process then proceeds to step 515 where the wireless headset 100 may operate in normal battery powered operation, followed by end step 517.

In an embodiment of the invention, a method and system are provided for wireless headset instant on capability during battery charging and may comprise powering a wireless headset 100 so that the wireless headset 100 may be operable to transmit and/or receive wireless signals while being charged. The wireless headset 100 may be powered via an external charging power source 107/109 coupled to the wireless headset 100 to enable the charging. The external charging power source may be coupled to the headset via a USB link 113. The wireless headset 100 may be powered via one or more internal batteries 205 within the wireless headset 100, and may be independent of a power level of the batteries 205 within the wireless headset 100.

RF and baseband circuitry within the wireless headset 100 may be powered to enable transmission and/or reception of wireless signals while the wireless headset 100 may be charged. The wireless headset 100 may manage power utilizing USB power management, and may manage discharge of power from a plurality of internal batteries 205 within the headset. The batteries 205 may be decoupled from circuits that enable transmitting and/or receiving of wireless signals when the wireless headset 100 is being charged. The wireless headset 100 may be powered via the charging device 107/109 so that the wireless headset 100 may be operable to generate output audio signals during the charging of the wireless headset 100.

In an embodiment of the invention, a method and system are provided for wireless headset instant on capability during battery charging and may comprise powering one or more circuits in the wireless headset utilizing a charging source 107/109. The powering may be independent of a state of the batteries when the wireless handset 100 may be coupled to the charging source 107/109. The circuits may comprise baseband circuitry and may be utilized to communicate with wireless devices, which may be utilized to configure the wireless headset 100. The charging source 107 may be coupled via a USB connection 113. The circuits may enable USB power management, which may enable the negotiation of the charging conditions from the charging source 107. The batteries may be decoupled from the circuits when the charging source 107/109 may be powering the circuits. The wireless headset 100 may comprise a Bluetooth headset. The charging source 107/109 may concurrently charge the batteries while powering the circuits.

Certain embodiments of the invention may comprise a machine-readable storage having stored thereon, a computer program having at least one code section for wireless communication, the at least one code section being executable by a machine for causing the machine to perform one or more of the steps described herein.

Accordingly, aspects of the invention may be realized in hardware, software, firmware or a combination thereof. The invention may be realized in a centralized fashion in at least one computer system or in a distributed fashion where different elements are spread across several interconnected computer systems. Any kind of computer system or other apparatus adapted for carrying out the methods described herein is suited. A typical combination of hardware, software and firmware may be a general-purpose computer system with a computer program that, when being loaded and executed, controls the computer system such that it carries out the methods described herein.

One embodiment of the present invention may be implemented as a board level product, as a single chip, application specific integrated circuit (ASIC), or with varying levels integrated on a single chip with other portions of the system as separate components. The degree of integration of the system will primarily be determined by speed and cost considerations. Because of the sophisticated nature of modern processors, it is possible to utilize a commercially available processor, which may be implemented external to an ASIC implementation of the present system. Alternatively, if the processor is available as an ASIC core or logic block, then the commercially available processor may be implemented as part of an ASIC device with various functions implemented as firmware.

The present invention may also be embedded in a computer program product, which comprises all the features enabling the implementation of the methods described herein, and which when loaded in a computer system is able to carry out these methods. Computer program in the present context may mean, for example, any expression, in any language, code or notation, of a set of instructions intended to cause a system having an information processing capability to perform a particular function either directly or after either or both of the following: a) conversion to another language, code or notation; b) reproduction in a different material form. However, other meanings of computer program within the understanding of those skilled in the art are also contemplated by the present invention.

While the invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A method for wireless communication, comprising:

powering a wireless headset so that said wireless headset is operable to transmit and/or receive wireless signals while said wireless headset is being charged, where the wireless headset is operable to generate output audio signals from received wireless signals while said wireless headset is being charged; and managing power within said wireless headset utilizing USB power management.

2. The method according to claim 1, comprising powering said wireless headset via one or more internal batteries within said wireless headset.

3. The method according to claim 1, comprising powering said wireless headset independent of a power level of one or more internal batteries within said wireless headset.

4. The method according to claim 1, comprising powering RF and baseband circuitry within said wireless headset for said transmitting and/or receiving of wireless signals while said wireless headset is being charged.

5. The method according to claim 1, comprising managing discharge of power from a plurality of internal batteries within said wireless headset.

6. The method according to claim 1, comprising decoupling one or more internal batteries within said wireless headset from one or more circuits within said headset, said one or more circuits enabling said transmitting and/or receiving of wireless signals when said wireless headset is being charged.

7. The method according to claim 1, wherein the USB power management enables the negotiation of the charging conditions from an external charging power source.

8. The method according to claim 1, comprising powering said wireless headset via an external charging power source coupled to said wireless headset to enable said charging.

9. The method according to claim 8, wherein said external charging power source is coupled to said wireless headset via a USB link.

10. A system for wireless communication, comprising:

one or more circuits within a wireless headset that enable powering of said wireless headset so that said wireless headset is operable to transmit and/or receive wireless signals while said wireless headset is being charged, where the wireless headset is operable to generate output audio signals from received wireless signals while said wireless headset is being charged, wherein said one or more circuits enable managing power within said wireless headset utilizing USB power management.

11. The system according to claim 10, wherein said one or more circuits enable powering of said wireless headset via one or more internal batteries within said wireless headset.

12. The system according to claim 10, wherein said one or more circuits enable powering said wireless headset independent of a power level of one or more internal batteries within said wireless headset.

13. The system according to claim 10, wherein said one or more circuits enable powering of RF and baseband circuitry within said wireless headset for said transmitting and/or receiving of wireless signals while said wireless headset is being charged.

14. The system according to claim 10, wherein said one or more circuits enable managing discharge of power from a plurality of internal batteries within said wireless headset.

15. The system according to claim 10, wherein said one or more circuits enable decoupling one or more internal batteries within said wireless headset from one or more circuits within said headset, said one or more circuits enabling said transmitting and/or receiving of wireless signals when said wireless headset is being charged.

16. The system according to claim 10, wherein the USB power management enables the negotiation of the charging conditions from an external charging power source.

17. The system according to claim 10, wherein said one or more circuits enable powering of said wireless headset via an external charging power source coupled to said wireless headset to enable said charging.

18. The system according to claim 17, wherein said external charging power source is coupled to said wireless headset via a USB link.

19. A non-transitory machine readable storage having stored thereon a computer program having at least one code section for wireless communication, said at least one code section being executable by a processor in a wireless headset to perform steps comprising:

powering said wireless headset so that said wireless headset is operable to transmit and/or receive wireless signals while said wireless headset is being charged, where the wireless headset is operable to generate output audio signals from received wireless signals during charging; and managing power within said wireless headset utilizing USB power management.

20. The non-transitory machine readable storage according to claim 19, wherein said at least one code section comprises code for powering said wireless headset via one or more internal batteries within said wireless headset.

21. The non-transitory machine readable storage according to claim 19, wherein said at least one code section comprises code for powering said wireless headset independent of a power level of one or more internal batteries within said wireless headset.

22. The non-transitory machine readable storage according to claim 19, wherein said at least one code section comprises code for powering RF and baseband circuitry within said wireless headset for said transmitting and/or receiving of wireless signals while said wireless headset is being charged.

23. The non-transitory machine readable storage according to claim 19, wherein said at least one code section comprises code for managing discharge of power from a plurality of internal batteries within said wireless headset.

24. The non-transitory machine readable storage according to claim 19, wherein said at least one code section comprises code for decoupling one or more internal batteries within said wireless headset from one or more circuits within said headset, said one or more circuits enabling said transmitting and/or receiving of wireless signals when said wireless headset is being charged.

25. The non-transitory machine readable storage according to claim 19, wherein the USB power management enables the negotiation of the charging conditions from an external charging power source.

26. The non-transitory machine readable storage according to claim 19, wherein said at least one code section comprises code for powering said wireless headset via an external charging power source coupled to said wireless headset to enable said charging.

27. The non-transitory machine readable storage according to claim 26, wherein said external charging power source is coupled to said wireless headset via a USB link.

28. A method for wireless communication, comprising:

powering a wireless headset so that said wireless headset is operable to transmit and/or receive wireless signals while said wireless headset is being charged, where the wireless headset is operable to generate output audio signals from received wireless signals while said wireless headset is being charged; wherein said external charging power source is coupled to said wireless headset via a USB link.

29. The method according to claim 28, comprising powering said wireless headset independent of a power level of one or more internal batteries within said wireless headset.

30. The method according to claim 28, comprising powering RF and baseband circuitry within said wireless headset for said transmitting and/or receiving of wireless signals while said wireless headset is being charged.

31. The method according to claim 28, comprising decoupling one or more internal batteries within said wireless headset from one or more circuits within said headset, said one or more circuits enabling said transmitting and/or receiving of wireless signals when said wireless headset is being charged.

32. A system for wireless communication, comprising:

one or more circuits within a wireless headset that enable powering of said wireless headset so that said wireless headset is operable to transmit and/or receive wireless signals while said wireless headset is being charged, where the wireless headset is operable to generate output audio signals from received wireless signals while said wireless headset is being charged, wherein said external charging power source is coupled to said wireless headset via a USB link.

33. The system according to claim 32, wherein said one or more circuits enable powering said wireless headset independent of a power level of one or more internal batteries within said wireless headset.

34. The system according to claim 32, wherein said one or more circuits enable powering of RF and baseband circuitry within said wireless headset for said transmitting and/or receiving of wireless signals while said wireless headset is being charged.

35. The system according to claim 32, wherein said one or more circuits enable managing discharge of power from a plurality of internal batteries within said wireless headset.

36. The system according to claim 32, wherein said one or more circuits enable decoupling one or more internal batteries within said wireless headset from one or more circuits within said headset, said one or more circuits enabling said transmitting and/or receiving of wireless signals when said wireless headset is being charged.

* * * * *